US007537089B2

(12) United States Patent
Duenser et al.

(10) Patent No.: US 7,537,089 B2
(45) Date of Patent: May 26, 2009

(54) ELEVATOR INSTALLATION WITH INDIVIDUALLY MOVABLE ELEVATOR CARS AND METHOD FOR OPERATING SUCH AN ELEVATOR INSTALLATION

(75) Inventors: Thomas Duenser, Rikon (CH); Philipp Angst, Zug (CH)

(73) Assignee: Inventio AG, Hergiswil NW (CH)

( * ) Notice: Subject to any disclaimer, the term of this patent is extended or adjusted under 35 U.S.C. 154(b) by 678 days.

(21) Appl. No.: 11/180,797

(22) Filed: Jul. 13, 2005

(65) Prior Publication Data

US 2006/0016640 A1 Jan. 26, 2006

(30) Foreign Application Priority Data

Jul. 22, 2004 (EP) ..... 04405467

(51) Int. Cl.
*B66B 1/20* (2006.01)
*B66B 9/00* (2006.01)

(52) U.S. Cl. ..... 187/249; 187/382; 187/902; 187/247

(58) Field of Classification Search ..... 187/380–382, 187/388, 902, 247, 249
See application file for complete search history.

(56) References Cited

U.S. PATENT DOCUMENTS

| | | | | |
|---|---|---|---|---|
| RE18,095 | E * | 6/1931 | Sprague | 187/249 |
| 1,837,643 | A * | 12/1931 | Anderson | 187/249 |
| 1,976,495 | A * | 10/1934 | Halfvarson | 187/249 |
| 5,419,414 | A * | 5/1995 | Sakita | 187/391 |
| 5,660,249 | A * | 8/1997 | Powell et al. | 187/249 |
| 5,663,538 | A | 9/1997 | Sakita | |
| 5,877,462 | A * | 3/1999 | Chenais | 187/249 |
| 6,273,217 | B1 * | 8/2001 | Hikita | 187/388 |
| 6,360,849 | B1 * | 3/2002 | Hikita | 187/381 |
| 6,364,065 | B1 * | 4/2002 | Hikita | 187/382 |
| 7,032,716 | B2 * | 4/2006 | Meyle et al. | 187/382 |
| 7,357,226 | B2 * | 4/2008 | Sakita | 187/249 |
| 7,377,365 | B2 * | 5/2008 | Abe et al. | 187/396 |
| 2003/0098208 | A1 | 5/2003 | Hikita | |
| 2003/0217893 | A1 | 11/2003 | Dunser et al. | |
| 2004/0089504 | A1 * | 5/2004 | Kostka | 187/393 |
| 2006/0163008 | A1 * | 7/2006 | Godwin | 187/288 |

FOREIGN PATENT DOCUMENTS

| | | |
|---|---|---|
| EP | 0820952 A2 | 1/1998 |
| EP | 1 367 018 | 12/2003 |
| JP | 8282926 A | 10/1996 |
| WO | WO 2004/048243 | 6/2004 |

* cited by examiner

*Primary Examiner*—Walter Benson
*Assistant Examiner*—Eduardo Colon-Santana
(74) *Attorney, Agent, or Firm*—Fraser Clemens Martin & Miller LLC; Williams J. Clemens

(57) ABSTRACT

An elevator installation has a vertical elevator hoistway and a plurality of elevator cars individually movable therein. An elevator control system readies at least two of the elevator cars in the hoistway in an area of two mutually adjacent entrance areas. Thus, simultaneous loading/unloading of the elevator cars via the entrance areas is possible. The two elevator cars then travel to destination floors, the first elevator car traveling a distance which is at least as great as that traveled by the second elevator car.

16 Claims, 5 Drawing Sheets

ELEVATOR INSTALLATION WITH INDIVIDUALLY MOVABLE ELEVATOR CARS AND METHOD FOR OPERATING SUCH AN ELEVATOR INSTALLATION

BACKGROUND OF THE INVENTION

The present invention relates to elevator installations with a plurality of individually movable elevator cars and a method of operating such elevator cars.

Every elevator installation occupies a certain proportion of the space in a building which depends on the amount of traffic. The greater the amount of traffic, and the higher the building, the more space the elevator installation needs in relation to the usable surface area (net usable surface area) of the building. The performance of an elevator installation can be expressed as its so-called handling capacity. The handling capacity indicates how many persons can be transported per minute in an office building when the amount of traffic is high, for example at the start of a working day.

It is of great interest to minimize the space required by an elevator installation.

There are various methods of readying and operating more than only one elevator car in one elevator hoistway, of arranging several parallel elevator hoistways of an elevator installation, and of elevator cars transferring from one elevator hoistway into another elevator hoistway.

It is a disadvantage of the known elevators with several elevator hoistways that changing hoistways mechanically is very complex and in many cases proceeds only slowly. Consequently, when the amount of traffic is high, the handling capacity is limited.

From the European published patent application EP 1360718-A2 an elevator installation has become known having several elevator cars which have an autonomous linear drive on the car that makes it possible for the elevator cars to move independently in a vertical direction in the elevator hoistways. The elevator cars are so made that a horizontal movement can also be reliably executed.

Conventional elevator installations are known which, for the purpose of increasing the handling capacity, are equipped with a so-called double-deck car. A double-deck car is an elevator car with two passenger compartments arranged one above the other. Such a double-deck car can, when it stops at a boarding zone of the elevator installation, be loaded/unloaded simultaneously from two floors. By this means, the handling capacity is sharply improved. However, it has become apparent that a method with double-deck cars also brings disadvantages. Such disadvantages are that such an elevator installation cannot be deployed flexibly because the entire double-deck car must always be moved even if only a small transportation capacity is necessary, and that both car decks must interrupt their travel if a halt needs to be made at a floor for passengers of one car deck. Furthermore, the distance between the decks of the double-deck car must take account of the distance between the floors. In many cases, the distance between the individual floors is not equal, which requires complex measures on the double-deck car.

It is a disadvantage of the known elevator installations with several elevator cars traveling in one hoistway that the transportation capacity is limited by a relatively small number of elevator cars departing from a main stop per unit of time. The maximum achievable number of cars departing per unit of time is limited inter alia by the time needed for opening and closing the doors and for allowing the passengers to exit and board the elevator car.

SUMMARY OF THE INVENTION

In view of the known arrangements it is a purpose of the present invention to make available an elevator installation and a corresponding method which reduce or completely avoid the disadvantages of the state of the art.

A particular purpose of the present invention is to make available an elevator installation and corresponding method in which the handling capacity in relation to a unit of area or volume of a building is higher than with known methods.

The present invention is based on the fact that the process of loading and unloading elevator cars, which in itself is relatively time-consuming, can take place in such manner that at least two elevator cars can be loaded/unloaded more or less simultaneously. At the same time, great flexibility of readying and moving the elevator cars is made possible in that a plurality of elevator cars is employed which are, or can be, individually driven, and can therefore move in the elevator installation independent of each other.

An additional increase in the handling capacity can be achieved by there being two or more elevator hoistways which allow spatially separated upward and downward movement of the elevator cars instead of there being only one elevator hoistway which is operated as a two-way hoistway.

DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
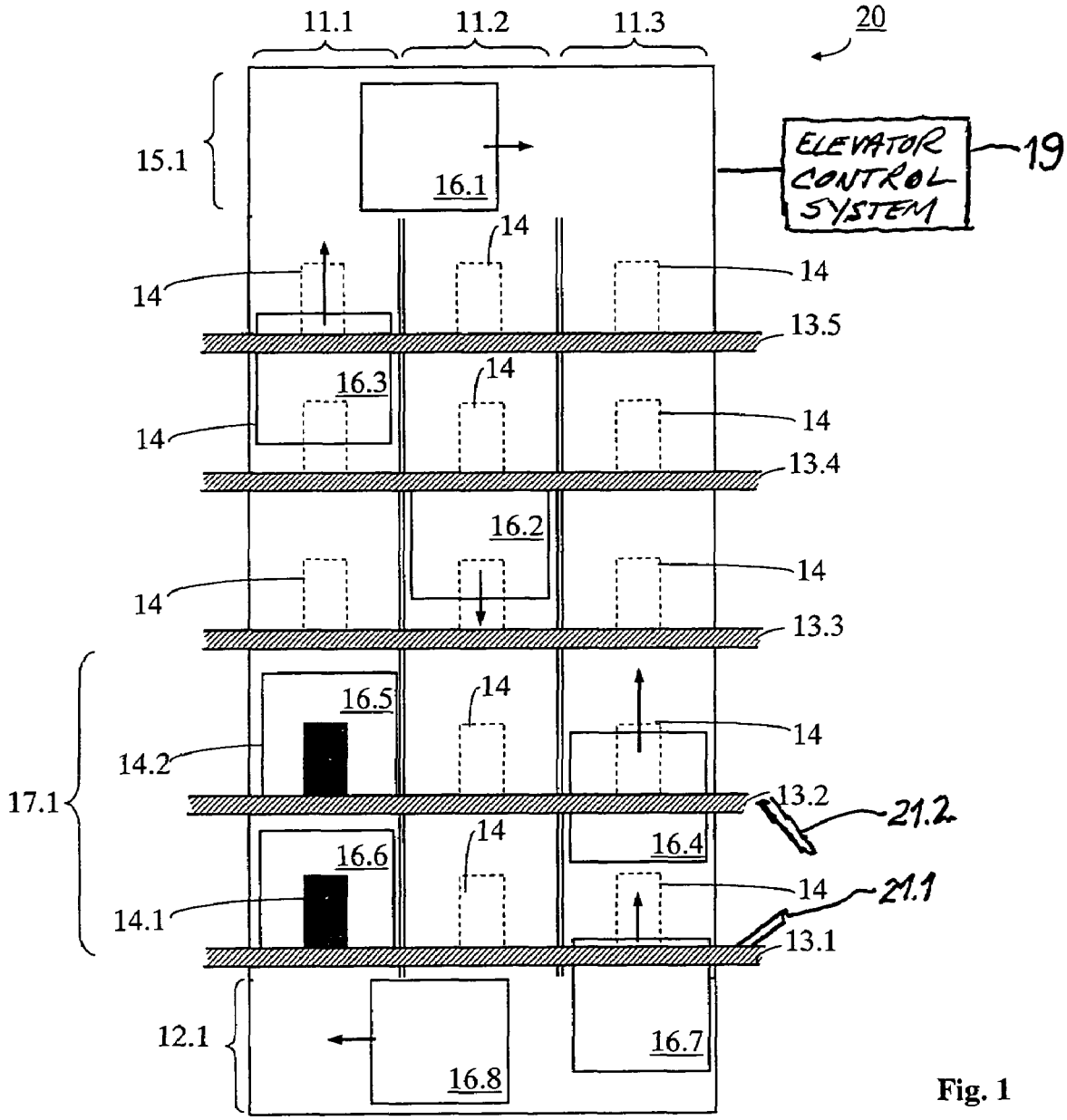
FIG. 1 is a schematic cross-sectional side view of a first embodiment elevator installation according to the present invention.

A first embodiment of the present invention is described by reference to FIG. 1. An elevator installation 20 is shown in cross section from one side. The elevator installation 20 comprises at least one vertical elevator hoistway 11.1. In the embodiment of the present invention shown, there are n=3 vertical elevator hoistways 11.1, 11.2, and 11.3 arranged adjacent to each other. The vertical elevator hoistways 11.1, 11.2, and 11.3 can, but need not, be spatially separated from each other. A total of five floors 13.1 through 13.5 are served. In the elevator hoistways 11.1, 11.2, and 11.3 are several individually movable elevator cars 16.1 through 16.8. In the example shown, there is at least one transfer zone 12.1 in the area beneath a boarding zone 17.1 which allows movement of the elevator cars 16.1 through 16.8 between the elevator hoistways 11.1, 11.2, and 11.3. The boarding zone 17.1 in the present exemplary embodiment is regarded as comprising the entrance areas of the two lowest floors 13.1, 13.2. The boarding zone 17.1 can, for example, also be positioned in a main stop, a main entrance, or a main lobby. In the example shown, there are present on every floor doors which are referenced with 14. Just at the instant shown, there are two elevator cars 16.5 and 16.6 in the boarding zone 17.1, and the corresponding doors 14.1, 14.2 are open. For simplicity, the open doors are shown black.

According to the present invention, the two elevator cars 16.5 and 16.6 form a temporary multi-deck arrangement for the purpose of accelerating the process of loading/unloading. Concretely, the present example is a temporary double-deck arrangement.

The elevator installation 20 can now be operated as follows: In case of need, for example at times with a higher requirement for transportation, the two elevator cars 16.5, 16.6 can be made available simultaneously in the boarding zone 17.1 of the elevator hoistway 11.1 for immediate loading/unloading.

It is preferable for further elevator cars 16.7, 16.8 to be held ready in the transfer zone 12.1. Every time elevator cars have departed from the boarding zone 17.1, elevator cars move up from the transfer zone to replace them. In the exemplary embodiment shown, an elevator car 16.4 has started the upward journey in the elevator hoistway 11.3, and the elevator car 16.7 is moving up from the transfer zone 12.1 to replace it. The elevator car 16.8 moves up into an area of the transfer zone 12.1 which is situated beneath the elevator hoistway 11.1. A further elevator car 16.3 is in the elevator hoistway 11.1 traveling upwards, and an elevator car 16.2 is in the elevator hoistway 11.2 traveling downwards. The elevator car 16.1 is just executing a change of hoistway in a transfer zone 15.1.

The transfer zones 12.1, 15.1 are so designed that the elevator cars can be moved horizontally individually or together. To allow horizontal movement together, there is preferably at least one transfer zone whose height is so designed that two elevator cars in a temporary double-deck arrangement can be moved, which leads to a further acceleration of the change of hoistway, especially since the elevator cars moved in temporary double-deck arrangement can be inserted into an elevator hoistway 11.1 together and there made ready.

Should two or more elevator cars form a temporary multi-deck arrangement, it is important that when both elevator cars are being moved, the first of the two elevator cars 16.5 travels to a first destination floor that lies above a second destination floor which is traveled to by the second of the two elevator cars 16.6. In other words, the first elevator car 16.5 travels a distance which is at least as great as the distance that must be traveled by the second elevator car 16.6. It is also important to ensure that the first elevator car 16.5 moves just as fast as the second elevator car 16.6 to avoid collisions.

An elevator installation with several individually driven elevator cars working in double-deck mode could also be operated in two-way mode. In this mode of operation, the elevator cars always move in the same elevator hoistway, both upwards and downwards. For such operation, no transfer zone is necessary.

Through the use of a temporary multi-deck arrangement, the handling capacity is substantially improved without the flexibility of the elevator installation being impaired.

Advantageously, a temporary multi-deck arrangement is made ready when an increased requirement for transportation is expected or when an increased requirement for transportation is detected.

It is an advantage of the present invention that the readying of two or more elevator cars in temporary multi-deck arrangement can also be ended again at any time and a normal mode can be operated with individual loading/unloading and individually moving elevator cars.

Below, several of the terms used are defined more precisely before further embodiments of the invention are discussed.

An elevator hoistway is defined as an area of a building which is designed for vertical upward and/or downward movements of elevator cars. However, when interpreting the term "elevator hoistway", it must be taken into account that a spatial separation between the individual elevator hoistways of an elevator installation is not obligatory. The present invention can be applied to elevator installations with spatially separated or unseparated elevator hoistways.

According to the present invention, the elevator cars are individually movable. The individual movability can be realized by various means, and several ways of executing such elevator installations are known from the state of the art which can be used in association with the present invention.

Should the elevator installation have more than one elevator hoistway, it is advantageous if the elevator cars can be moved from one elevator hoistway into another elevator hoistway. For this purpose, the elevator hoistways and the elevator cars must be so executed that the elevator cars in addition to being movable in vertical direction can also be moved horizontally between the elevator hoistways or can execute a horizontal movement of their own accord. Also for this purpose, there are several examples from the state of the art which will not be discussed in detail here, since the horizontal movement is not essential to the present invention.

Two or more entrance areas arranged above each other are defined as a "boarding zone". In the present description, the ground floor and an additional floor above or below the ground floor are regarded as a boarding zone because here, depending on the arrangement of the entire building, a particularly high incidence of traffic prevails. The boarding zone can, however, also be located in the area of one single floor, for example a main stop, a main entrance, or a main lobby, possibly with stairs or moving walks leading from one main entrance level to another, or several other, entrance level(s).

In an elevator installation according to FIG. 1 it is, for example, conceivable that from a ground floor—not shown in FIG. 1—situated between floors 13.1 and 13.2 a first stairway 21.2 leads into the first floor 13.2 and there to the elevator car 16.5 positioned in the elevator hoistway 11.1, and a second stairway 21.1 leads into a first basement floor 13.1 to the elevator car 16.6 positioned in the same elevator hoistway 11.1. The respective floors together are defined within the meaning of the present invention as a boarding zone. A boarding zone can also be arranged in another area of an elevator installation, for example in the upper hoistway area. There can also be several boarding zones in one elevator installation.

The entrance areas need not correspond to the floors of the building. It is also conceivable that loading/unloading the elevator cars of a temporary multi-deck arrangement takes place via intermediate floors, ramps, or suchlike.

The terms "boarding zone" and "boarding level" shall also apply synonymously to exit zones and exit levels respectively. Self-evidently, the term "load" shall also included unloading. The term "entrance area" shall also include exit areas.

According to the present invention, the direction of travel in the individual elevator hoistways need not be determined. Through a traffic-dependent elevator control system, an elevator installation with n=5 elevator hoistways can be so controlled that in the mornings more elevator hoistways are provided for upward travel of the elevator cars than for downward travel. Towards evening, more downward hoistways than upward hoistways are provided. However, the present invention can also be applied to elevator installations which have a fixed allocation of upward and downward hoistways.

The present invention is essentially independent of the position and arrangement of the boarding openings or doors. The doors can lie in the plane of the drawing of FIGS. 2 to 5 or in another plane perpendicular to the plane of the drawing.

The present invention can be employed particularly advantageously when n≧2 elevator hoistways are provided. Also advantageous is an elevator installation which has at least one transfer zone for horizontal movement of the elevator cars.

Figure 2:
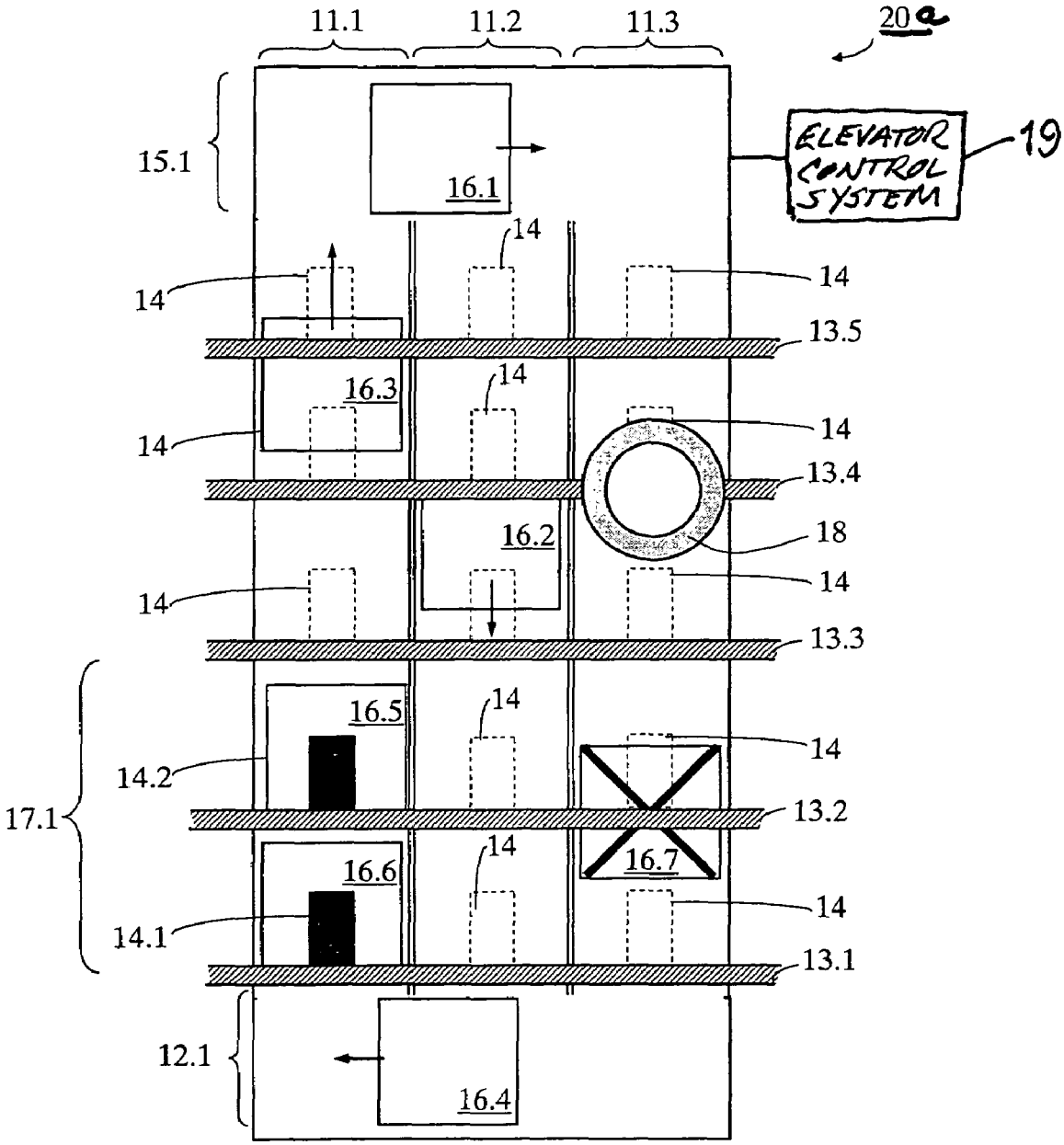
FIG. 2 is a schematic cross-sectional side view of a second embodiment elevator installation according to the present invention.

The arrangement and an alternate mode of operation of a second embodiment elevator installation 20*a* according to the present invention is represented in FIG. 2, only the fundamental elements being shown. The elevator installation 20 shown has n=3 elevator hoistways 11.1, 11.2, and 11.3. Here, too, the five floors 13.1 through 13.5 are served. Within the elevator hoistways 11.1 through 11.3 there are several individually movable elevator cars 16.1 through 16.6 which are currently deployed. An elevator car 16.7 is currently not moving and therefore blocks the elevator hoistway 11.3 (marked with a "No vehicles" symbol 18). A transfer zone 12.1 is provided in the area of the lower boarding zone 17.1 and a transfer zone 15.1 is provided in the vicinity of the upper end of the hoistway which allows movement of the elevator cars 16.1 through 16.7 between the elevator hoistways 11.1 through 11.3.

The advantages of the present invention are described by reference to an (exceptional) situation which is indicated in FIG. 2. In the example shown, the elevator car 16.7 blocks the elevator hoistway 11.3. The traffic must therefore, under the influence of a suitable elevator control system, be handled in the two remaining elevator hoistways 11.1, 11.2. The elevator hoistway 11.1 serves as an upward hoistway and the elevator hoistway 11.2 as a downward hoistway. So as to be able still to provide sufficient handling capacity, a temporary multi-deck arrangement is composed of the elevator cars 16.5 and 16.6 in the boarding zone 17.1. Temporarily, the floors 13.1 and 13.3, which are situated directly above each other, serve as boarding zone 17.1. This can be indicated by corresponding signalization in the area of the entrance openings 14.1, 14.2.

As soon as the elevator cars 16.5 and 16.6 have left the boarding zone 17.1, the elevator car 16.4 moves up into the position which was previously occupied by the elevator car 16.5. A short time after, the elevator car 16.2 will move up into the position which was formerly occupied by the elevator car 16.6.

A further, similar third embodiment is explained by reference to FIG. 3, but this figure will only be discussed here to the extent that it differs from the previous figures. An elevator installation 20*b* has three elevator hoistways 11.1 through 11.3. Arranged under the floor 13.1 are two transfer zones 12.1 and 12.2. A further transfer zone 15.1 is situated at the upper end of the hoistway. The elevator hoistway 11.3 is again blocked (marked with the "No vehicles" symbol 18). Two elevator cars 16.5 and 16.6 are ready for loading/unloading. Two further elevator cars 16.4 and 16.8 are moving horizontally under the elevator hoistway 11.1 so as to be able to move up as quickly as possible after the elevator cars 16.5, 16.6 have departed upward either individually or in double-deck arrangement. With this embodiment, the two elevator cars 16.4 and 16.8 can already be brought into a moving-up position so as to accelerate moving up. The transfer zones 12.1, 12.2 are preferably so designed that bringing into the vertical elevator hoistway 11.1 takes place quickly. For this purpose, a special mechanical device can be provided which raises the two elevator cars 16.4 and 16.8 from the moving-up position and transfers them into the elevator hoistway 11.1.

Figure 3:
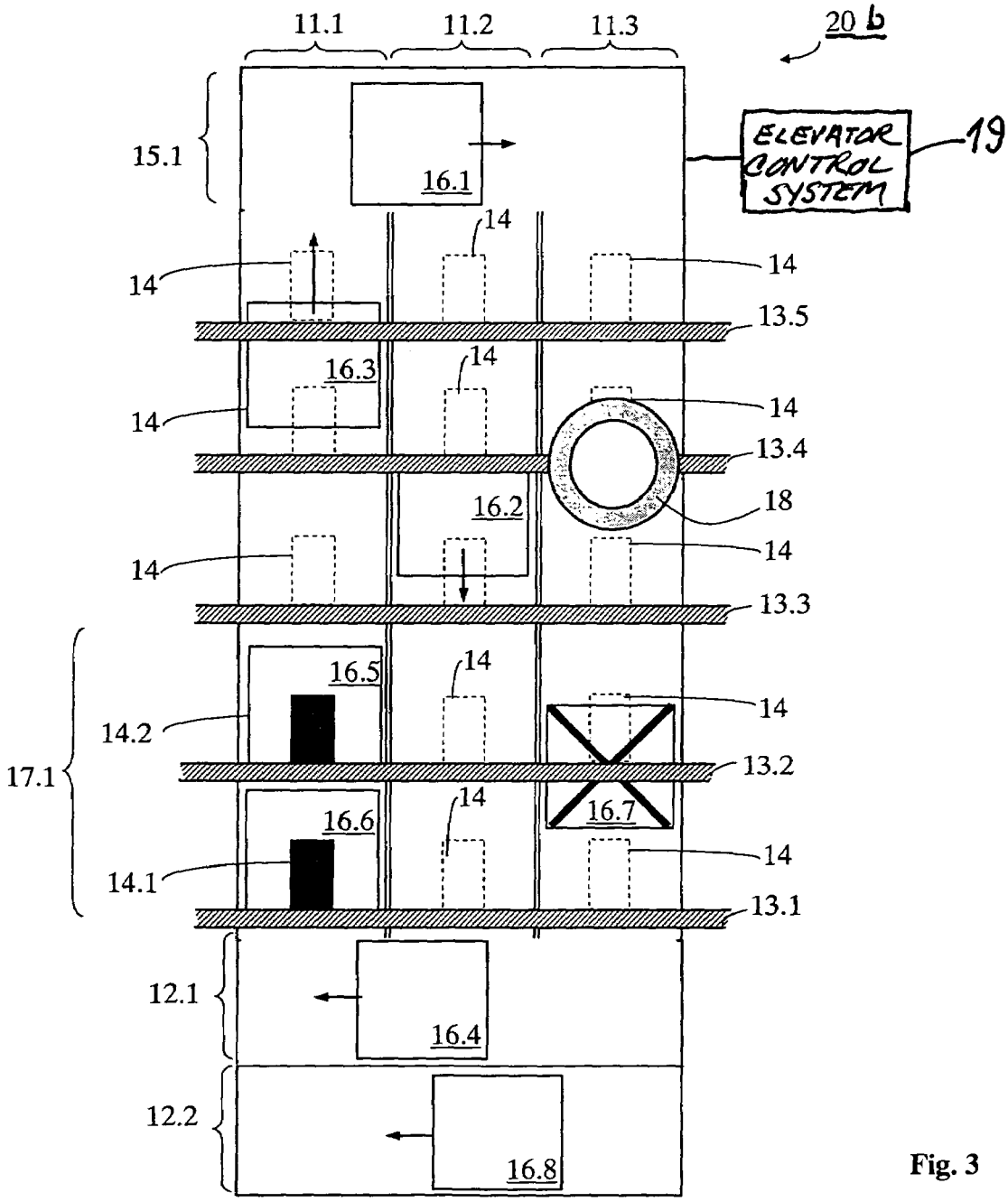
FIG. 3 is a schematic cross-sectional side view of a third embodiment elevator installation according to the present invention.

It is preferable for the embodiment shown in FIG. 3 to be so designed that two elevator cars can be moved together horizontally into the multi-deck arrangement, which leads to a further increase in the handling capacity.

Figure 4:
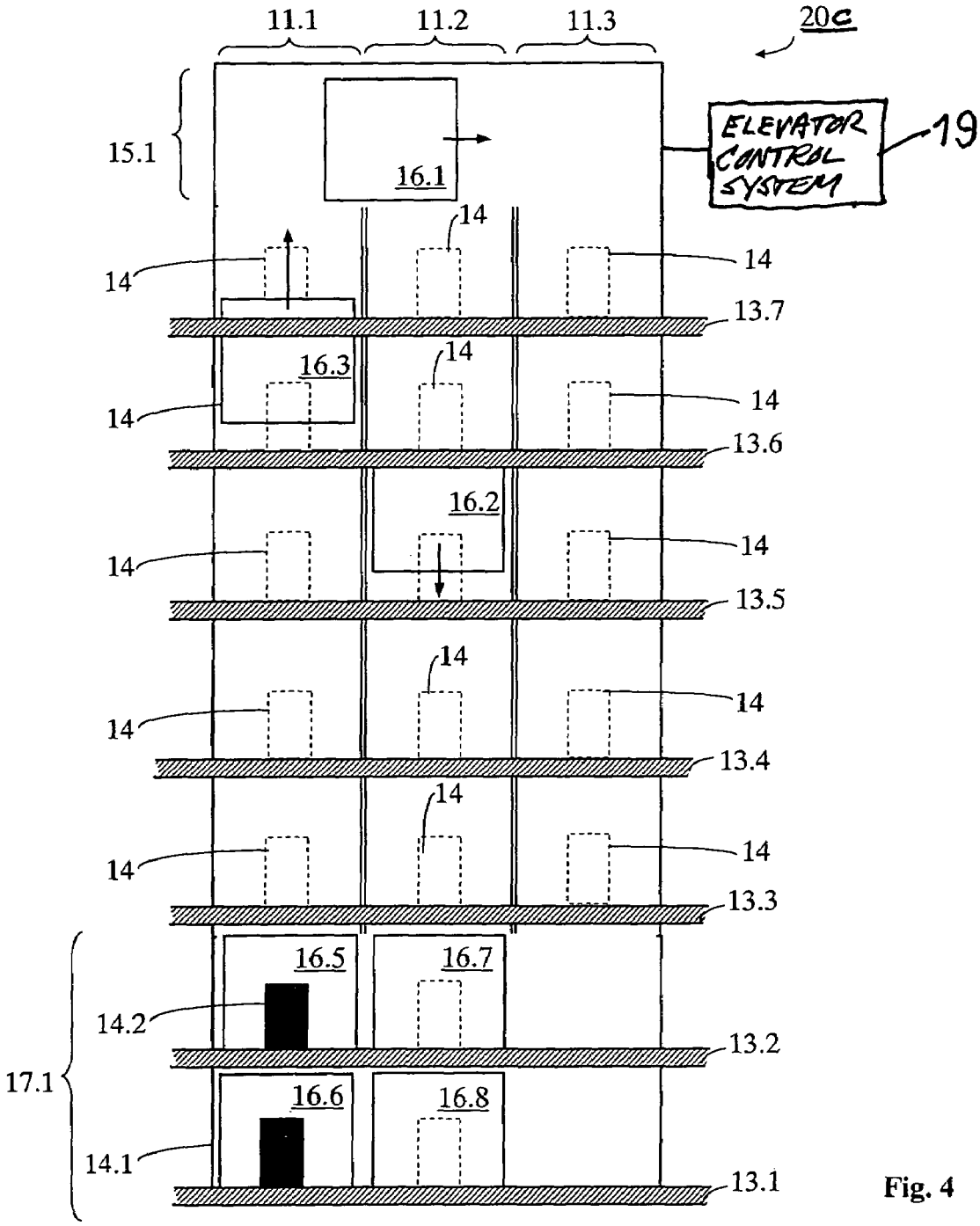
FIG. 4 is a schematic cross-sectional side view of a fourth embodiment elevator installation according to the present invention.

A further, similar fourth embodiment is explained by reference to FIG. 4, but this figure will only be discussed here to the extent that it differs from the previous figures. An elevator installation 20*c* again has three elevator hoistways 11.1 through 11.3. The floors 13.1, 13.2 serve both as transfer zones and as boarding zones 17.1. The elevator cars 16.7, 16.8 are already in a moving-up position. This embodiment is particularly advantageous when there is insufficient space for one or more transfer zones under the elevator hoistways. The changing mechanism is advantageously so designed that a faster change of the elevator cars from the moving-up position into the elevator hoistway 11.1 is possible. Especially preferred is a variant in which the two elevator cars in the multi-deck arrangement can be moved horizontally together.

Figure 5:
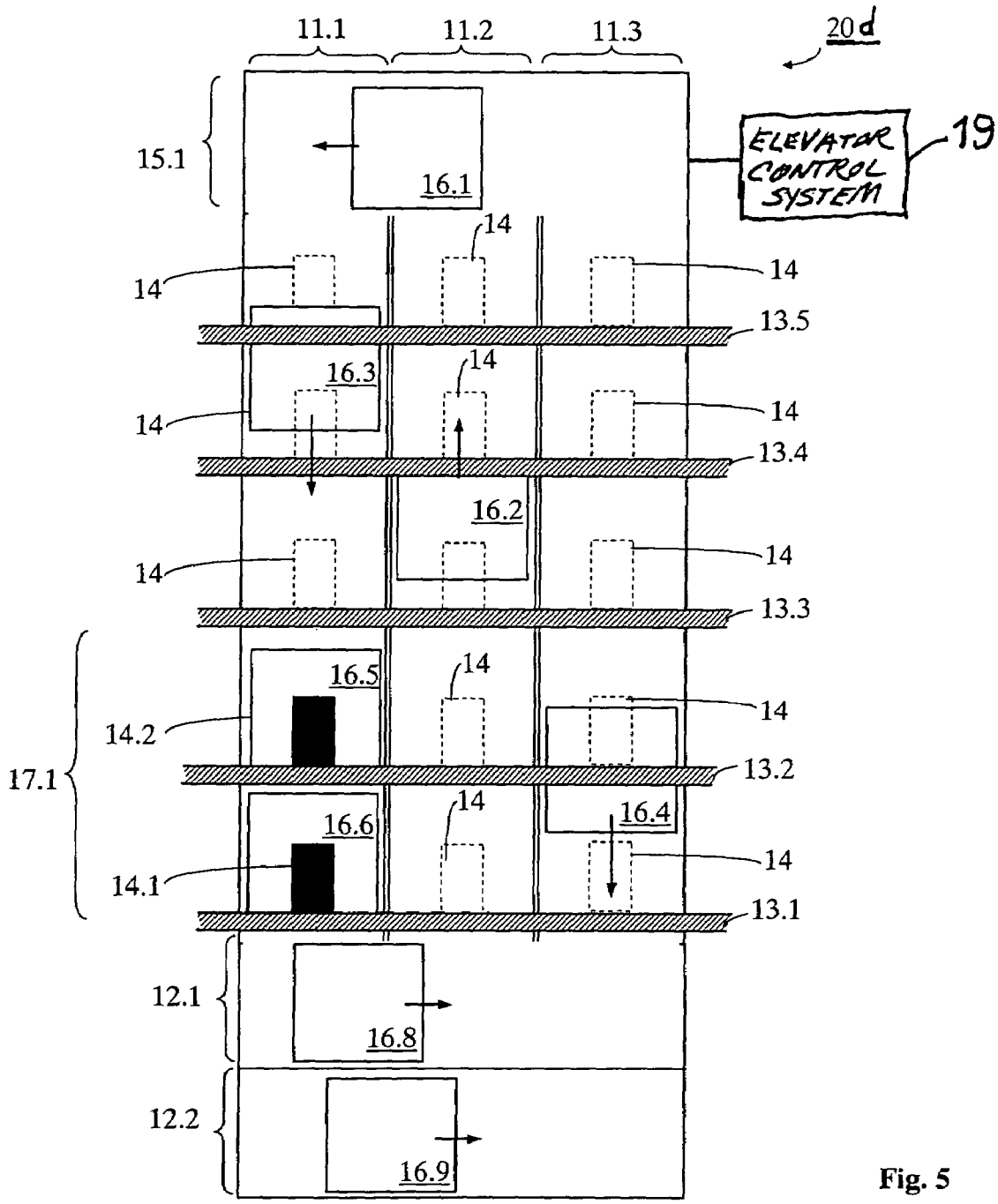
FIG. 5 is a schematic cross-sectional side view of a fifth embodiment elevator installation according to the present invention.

In FIG. 5 a fifth elevator installation 20*d* is shown which is executed in similar manner to that in FIG. 3. FIG. 5 serves to explain the mode of operation of an elevator installation according to the present invention in an emergency situation (evacuation of the building). The two outer elevator hoistways 11.1 and 11.3 are used as downward hoistways, and the middle elevator hoistway 11.2 serves as upward hoistway. The elevator installation 20*d* according to FIG. 5 has an elevator control system which coordinates the individual operations that are necessary in such an emergency situation. To increase the handling capacity for evacuation of a building, at least one of the two elevator hoistways 11.1, 11.3 serving as downward hoistways can be operated with temporary double-deck cars. When doing so, at least two elevator cars—preferably according to a stored rule—are distributed in the upper area of the building in the area of adjacent floors, or on various floors, in at least one of the downward hoistways 11.1, 11.3. After loading at least two elevator cars, these—grouped into a multi-deck arrangement—are transported to an evacuation exiting zone which comprises at least two entrance areas 13.1, 13.2 and in the present case corresponds to the boarding zone 17.1. Here, the evacuated persons can leave the elevator installation on at least two levels (entrance areas) simultaneously. The empty cars are subsequently transported to the upward hoistway, and into the upper area of the building, where they are available for further evacuation trips.

Important in the case of an evacuation is that the elevator control system is designed intelligently so that, depending on the situation, as large a transportation capacity as possible can be made available very quickly. In an emergency situation, use is preferably made of a corresponding optical signalization so that loading/unloading of the elevator cars can be executed safely and quickly. Acoustic signals can be used in addition.

To move the elevator cars vertically it is preferable for autonomous linear drives to be used. An exemplary technical realization for horizontal movement of the elevator cars is to be found in the European patent publication EP 1367018-A2.

Instead of an autonomous linear drive on the car, the elevator cars can also be provided with a friction-wheel drive, gearwheel drive, rack drive, or suchlike.

According to a further embodiment of the invention, the elevator system 20 (20*a*-20*d*) has an elevator control system 19 which is so designed that a so-called requirements profile is used to enable needs-dependent provision of temporary multi-deck cars from at least two elevator cars. Such a requirements profile can, for example depending on the time of day, be permanently specified or it can adapt itself dynamically to recognized events and utilization situations. The requirements profile is preferably stored in a memory. Especially suitable is a requirements profile in which certain basic patterns of demand are specified, but which through observation of the daily elevator operation automatically develop further. Preferably programmed in the elevator control system are routine procedures which specify the readying and movement of the elevator cars according to certain rules.

According to a preferred embodiment, the control system 19 of the elevator installation is so designed that at least one of the elevator cars of a temporary multi-deck arrangement can execute a long-distance travel in which this elevator car passes by several floors without stopping. Expediently, that elevator car is used for long-distance trips which in the upward hoistway is the top, and in the downward hoistway the bottom, elevator car of the temporary multi-deck arrangement.

It is an advantage of the method according to the present invention that it can be extended without limit and used in highly diverse elevator installations. Thus, according to the present invention, several floors can be included in the area of the boarding zone 17.1, in which case more than two elevator cars form a temporary multi-deck arrangement.

It is an advantage of the arrangement that the handling capacity in relation to the occupied surface area of the building can be increased by comparison with conventional elevator installations.

According to the invention, the handling capacity per elevator hoistway is maximized, and the hoistway volume required is minimized in relation to the handling capacity.

It is a further advantage of the present invention that in an elevator installation with several elevator hoistways, when one elevator hoistway cannot be used, a residual availability can be guaranteed which is greater than the availability of a conventional elevator installation.

To counteract the disadvantage that the passengers must board and exit on two different floors or entrance areas, special supporting measures can be taken. For example, an optimally informative signalization can be provided, and/or escalators or moving walks can be employed, to take passengers to the respective entrance areas.

It is preferable for the elevator control system 19 to be equipped with a destination control system which allows each passenger according to his individual destination to be assigned to, and by means of signalization guided to, that elevator car of the multi-deck arrangement which is scheduled to stop at the desired floor. The possibility thereby provided of destination-dependent assignment of the passengers to an elevator car of the multi-deck arrangement which travels to the desired destination ensures that the elevator cars of the multi-deck arrangement traveling towards their respective individual destinations mutually hinder each other as little as possible during their travel.

According to the present invention, an elevator installation and a method are proposed which allow good handling capacities with a reasonable building-constructional outlay. The present invention offers great flexibility, since in case of need several elevator cars can be readied together.

The more transfer zones that are provided, the more flexibly the traffic concept of the elevator installation can be designed, while on the other hand the space required obviously increases.

By means of the present invention, the waiting times in front of the elevator hoistways and the time spent in the elevator cars are made shorter. By comparison with conventional elevators, the building construction costs can be reduced.

Further characteristics of the present invention are:

A. Simultaneous loading/unloading of several elevator cars in the same hoistway;

B. Simultaneous or near-simultaneous departure of the elevator cars of a temporary multi-deck arrangement in the same elevator hoistway;

C. Maintenance of a high handling capacity in case of emergency or in maintenance situations;

D. Fast and efficient increase of the handling capacity in case of need;

E. In case of need, the possibility of redefining further floors as belonging to the boarding zone;

F. The possibility of several elevator cars in combination departing from the area of the boarding zone (up-peak or down-peak mode) or arriving there in combination (for example in the case of an evacuation);

G. The possibility that through suitable assignment of passengers to certain elevator cars of a multi-deck arrangement according to their destination, fewer stops at floors per elevator car are required than with conventional elevator installations; and H. Through coordinated travel of the elevator cars which form a temporary multi-deck arrangement, the possibility when loading/unloading of being able to reduce the mutual hindrance of the individually movable elevator cars in the elevator hoistway.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method of operating an elevator installation with a first vertical elevator hoistway and a plurality of elevator cars individually movable in the first hoistway comprising the steps of:

a. readying at least two of the elevator cars in the first hoistway in two entrance areas of the first hoistway which are situated one immediately above the other;

b. permitting simultaneous loading/unloading of the readied elevator cars via the entrance areas; and c. moving the readied elevator cars in the first hoistway from the entrance areas to individually assigned destination floors.

2. The method according to claim 1 including operating an elevator control for the readied elevator cars whereby in a first transportation step a travel distance to the assigned destination floor for the readied elevator car traveling in front is at least as great as a travel distance for the respectively following readied elevator car.

3. The method according to claim 1 including at least a second elevator hoistway in the elevator installation connected to the first hoistway, wherein upward movement and downward movement of the elevator cars is limited to respective ones of the first and second hoistways.

4. The method according to claim 3 including moving empty ones of the elevator cars horizontally between the first and second hoistways.

5. The method according to claim 4 wherein the horizontal movement is executed autonomously by the respective elevator car or by a stationary transfer mechanism.

6. The method according to claim 1 including allocating each passenger to one of the readied elevator cars which is scheduled to stop at a floor corresponding to the passenger's individual destination and guiding each passenger to the one readied elevator car.

7. The method according to claim 1 including execution of a long-distance trip by moving a leading one of the readied elevator cars past several floors without stopping.

8. The method according to claim 1 wherein an emergency procedure for the evacuation of persons includes the steps of:

d. readying at least two of the elevator cars in an upper area of the elevator installation;

e. loading the readied elevator cars with persons to be evacuated from the upper area; and f. moving the readied elevator cars from the upper area to an evacuation exiting zone with at least two entrance areas where the transported persons can leave the readied elevator cars simultaneously.

9. The method according to claim 8 including execution of a long-distance trip by moving a leading one of the readied elevator cars from the upper area past several floors without stopping.

10. An elevator installation comprising:

a first vertical elevator hoistway;

a plurality of elevator cars which are individually vertically movable in said first hoistway; and an elevator control system for readying at least two of said elevator cars in the first hoistway in at least two entrance areas situated immediately above one another to enable essentially simultaneous loading/unloading of said readied elevator cars via said entrance areas, wherein after simultaneous loading/unloading said readied elevator cars are operated to travel to individually assigned destination floors.

11. The elevator installation according to claim 10 wherein said elevator control system assigns to a leading one of said readied elevator cars destination floors which are furthest away and to a last-following one of said readied elevator cars destination floors which are nearest.

12. The elevator installation according to claim 10 including a second elevator hoistway and means for horizontal movement of said elevator cars between said first hoistway and said second hoistway, said second hoistway being parallel to said first hoistway and said elevator cars executing the horizontal movement autonomously or by a stationary transfer mechanism.

13. The elevator installation according to claim 12 including at least one transfer zone connecting said first hoistway with said second hoistway to enable the horizontal movement of said elevator cars.

14. The elevator installation according to claim 10 wherein said elevator control determines and signals an assignment and guidance of each passenger to one of the at-least two entrance areas situated immediately one above the other and thereby to the one of the readied elevator cars scheduled for a stop at a floor corresponding to each passenger's destination.

15. The elevator installation according to claim 10 including at least one escalator or moving walk for transporting passengers to at least one of said at-least two entrance areas.

16. The elevator installation according to claim 10 including at least one transfer zone connecting said first hoistway with said second hoistway to enable combined horizontal movement of two elevator cars between the first and second hoistways.

* * * * *